US005339710A

United States Patent [19]

Deadmond et al.

[11] Patent Number: 5,339,710

[45] Date of Patent: Aug. 23, 1994

[54] OFFSET LINE SOCKET

[76] Inventors: Bobby J. Deadmond, 909 Salem Pl., Fairview Heights, Ill. 62208; James E. Duvall, Jr., 1032 Villa Ridge, Collinsville, Ill. 62234

[21] Appl. No.: 78,507

[22] Filed: Jun. 21, 1993

[51] Int. Cl.[5] ..... B25B 17/00

[52] U.S. Cl. ..... 81/57.3; 81/58.2

[58] Field of Search ..... 81/57.14, 57.3, 58.2, 81/DIG. 9

[56] References Cited

U.S. PATENT DOCUMENTS

| | | | |
|---|---|---|---|
| 3,448,641 | 6/1969 | Morrow . | |
| 3,620,105 | 11/1971 | Batten | 81/58.2 X |
| 4,336,727 | 6/1982 | Junkers | 81/57.39 |
| 4,376,396 | 3/1983 | Hayhoe | 81/58.2 X |
| 4,441,387 | 6/1984 | Hendricks | 81/61 |
| 4,506,567 | 3/1985 | Marhlour | 81/58.2 X |
| 4,590,823 | 5/1986 | Neves et al. | 81/57.14 |
| 4,604,919 | 8/1986 | Rollo | 81/58.2 |
| 4,622,870 | 11/1986 | Shirley | 81/58.2 |
| 4,631,990 | 12/1986 | Hughes | 81/62 |

*Primary Examiner*—James G. Smith
*Attorney, Agent, or Firm*—Don W. Weber

[57] ABSTRACT

An offset line socket is presented which provides a tool for removing and installing line-nuts in close mechanical tolerance situations. The offset line socket is made up of a drive gear which is driven by a standard ratchet wrench. The drive gear is connected to two transfer gears which in turn drive the application gear. The application gear has an opening in it which is sufficient to allow the offset line socket to be placed over the pipe to be loosened or tightend. The hexagonal inner configuration of the application gear then attaches to the hexagonal line-nut. Once in place, a ratchet wrench drives the drive gear which in turn drives the application gear and removes or installs the hexagonal nut. The offset line socket is used in places where a standard wrench shaft would not turn because of mechanical obstructions. An alternate pivoting arm is also available for the socket which entirely closes the pipe access opening in the application gear for greater mechanical stability.

2 Claims, 3 Drawing Sheets

OFFSET LINE SOCKET

BACKGROUND OF INVENTION

This invention relates to the field of machine tools and more particularly to a wrench capable of removing and installing nuts in very tight mechanical situations.

In many applications currently in use in industry, for example water lines, gas lines, air conditioning lines, brake and hydraulic lines or other pneumatic lines, the various piping is connected by means of a wide hexagonal nut known as a line-nut. The ends of the pipe are threaded as are the internal portions of the line-nut. These pipes are frequently placed at or very near a wall or other obstruction, as the mechanics of the installation dictates. In order to service these various types of tubing or piping, it frequently becomes necessary to remove the line-nut in place as it was previously installed.

One prior method of removing this nut was simply to apply a normal adjustable wrench, open-end box wrench, or other similar device to the line-nut and to manually turn the nut until the pipes are loosened. However, one major drawback to this situation is that the nut, as installed, frequently allows little room in which to maneuver the elongated shaft of the wrench. This, in turn, causes the removal of the line-nut to be a slow, laborious and often costly process.

Another major drawback in the existing art of removing a line-nut involves the use of very specific torques which must be applied to the reinstallation of the line-nut once the servicing of the pipes or tubing has been accomplished. Frequently these line-nuts must be adjusted to a specific torque, hence a particular type of torque wrench must be used in reinstalling the line-nut in the line. Since these line-nuts are frequently installed in very tight mechanical situations, the use of the torque wrench to apply force directly to the line-nut is frequently cumbersome and, at times, nearly impossible. Another possibility, the use of a crow's foot socket and torque wrench has similar drawbacks.

Another difficult type of installation or servicing of the line-nut could occur when the line-nut is installed in a corner or near a number of upwardly projecting bolts or other obstructions. In this particular application it is often possible to place an open-end wrench or other type of wrench onto the line-nut or other type of nut, but the upwardly projecting protrusions frequently allow little room in which to move the shaft of the wrench in the direction necessary to remove the nut. It is an object of this invention to provide a tool which allows removal of a nut in a tight tolerance area.

It is another object of this invention to provide a tool which allows quick, offset removal of a line-nut which is installed very close to a wall or other obstruction. It is a still further object of this invention to provide a tool for removing nuts in tight tolerance areas which also allows the application of a standard torque wrench to adjust the tightening torque of the nut to the proper specification. Further and other objects of this invention will become apparent upon reading the following Specification.

BRIEF DESCRIPTION OF THE DEVICE

This device comprises essentially four main elements. A drive gear is assembled so that it contacts intermediate and smaller transfer gears. These transfer gears, in turn, transmit the force applied to the drive gear to an application gear. The application gear is open at one end and has an essentially hexagonal inner shape. The shape and size of the inner hexagonal portion of the application gear is designed such that it will grip the standard size hexagonal nuts frequently found in line-nut situations. The application gear opening is larger than the diameter of the line to be serviced. The offset line socket is thus easily slipped over the line through the line access opening and the inner hexagonal gripping shape of the application gear is then placed over the line-nut. Torque is then applied to the drive gear by means of a standard ratchet or torque wrench. Since the drive gear is offset from the application gear by a number of inches, the tight tolerance access problem is overcome.

For exceptionally high torque situations, the line access opening of the application gear may be closed once the socket is in place by use of an optional closure device.

A means is also provided to return the access opening to a predetermined position.

DETAILED DESCRIPTION OF THE PREFERRED EMBODIMENT

Figure 1:
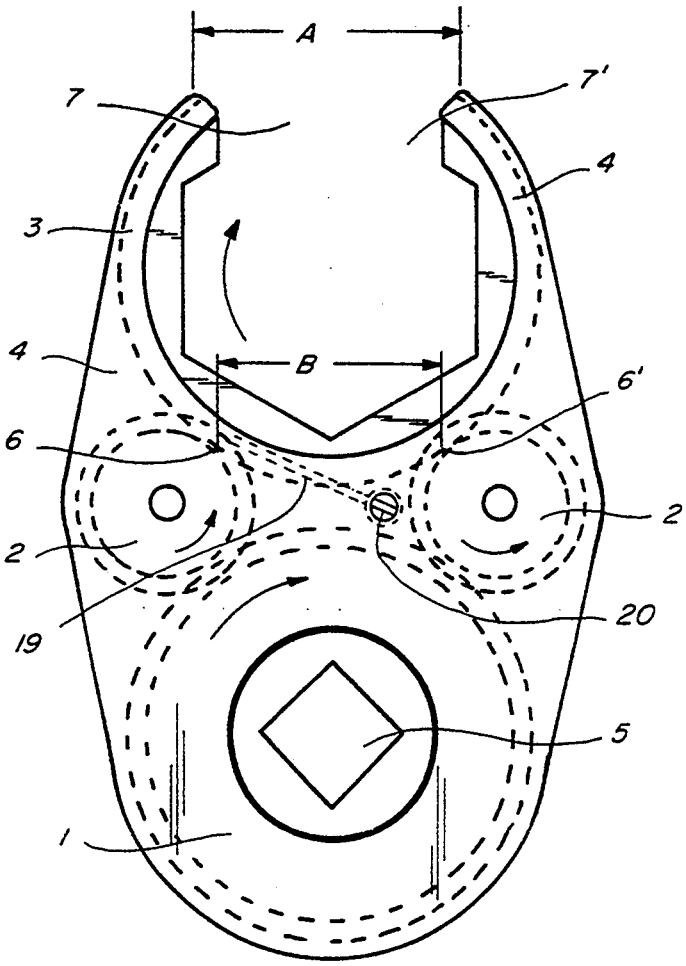
FIG. 1 is a top view showing the gears in dashed lines.

An offset line socket is presented comprising a drive gear mechanically connected to drive an application gear through a plurality of transfer gears. As best shown in FIG. 1, a drive gear 1 is placed within a casing 4 such that it rotates in the direction of the arrow shown on the drive gear 1 in FIG. 1. This drive gear 1 is driven by means of rotating the drive gear drive stump 5, as is commonly used in ratchet applications customary and normal in the mechanical arts.

The drive gear 1 rotates in a clockwise direction and is in mechanical contact with at least two transfer gears 2. These transfer gears rotate in a counterclockwise direction as shown by the arrows on the transfer gears 2.

These transfer gears 2 are in mechanical contact with the main application gear 3. The main application gear 3 is caused to rotate in the clockwise position by contact with the transfer gears 2. Thus, rotating the drive gear 1 in a clockwise direction also rotates the application gear in a clockwise position. Since the diameter of the drive gear and the diameter of the transfer gear is the same, the torque and direction applied to the drive gear will also be the torque and direction applied to the application gear 3.

Figure 2:
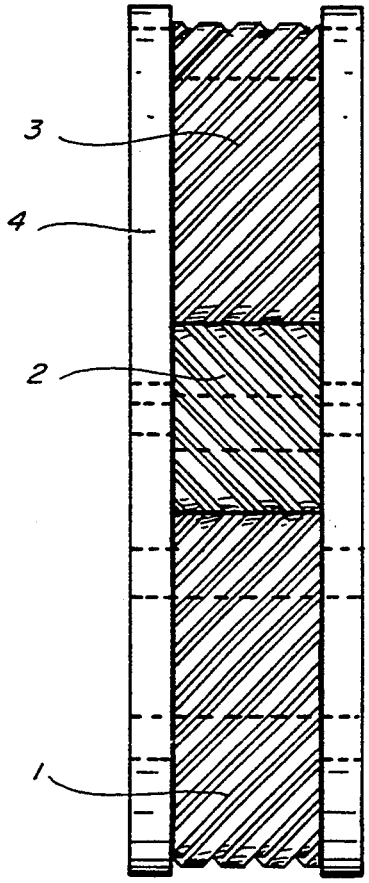
FIG. 2 is a side view of the device shown in FIG. 1 showing the gear system.

The entire device is encased within casing 4. As shown in FIG. 2, this casing 4 may take the form of two parallel surfaces, one located on each side of the inner gear system. However, in an alternative embodiment, keeping within the spirit and concept of this invention, the casing 4 may entirely encase the gear system so that the gear edges themselves are also encased by the outer casing 4.

Figure 3:
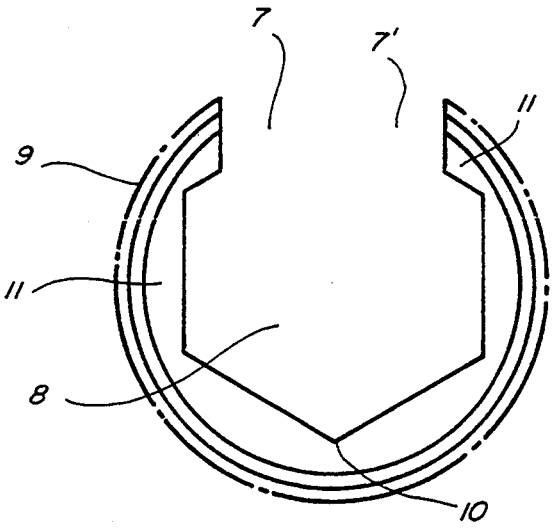
FIG. 3 is a top, planar detailed view of the application gear shown without the casing.

It is necessary to have at least two transfer gears 2 in order to operate this device. This requirement is necessary because of the line access opening 7 as shown on FIG. 1 and 3. This line access opening 7 is designed so that it is wide enough to allow the line, pipe or tubing to pass through the line access opening in order to attach the hexagonal gripping shape 8 to the line-nut to be removed or replaced.

Figure 4:
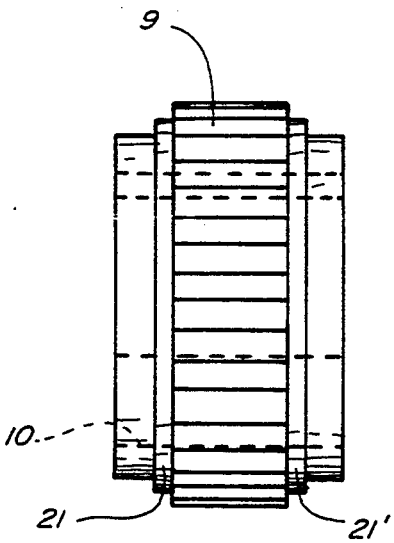
FIG. 4 is a side detailed view of FIG. 3.
Figure 5:
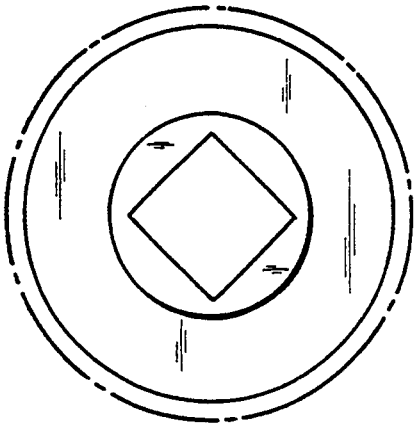
FIG. 5 is a top, planar detailed view of the drive gear shown without the casing.

The presence of the line access opening 7 requires at least two transfer gears 2 in order to continuously drive the application gear 3. As best shown on FIG. 1, the transfer gears 2 have a transfer gear/application gear tangent points 6 and 6'. The distance between tangent points 6 and 6' (the distance indicated by "B" on Drawing FIG. 1) must be greater than the outer diameter of the gear teeth of the application gear 3. (This outer gear teeth diameter is shown by the distance "A" on Drawing FIG. 1.) Distance "B" must be greater than distance "A" in order to continuously drive the application gear. Application gear teeth 9 (shown on FIG. 4) are thus always in mechanical contact with one or both of the transfer gears 2.

Figure 7:
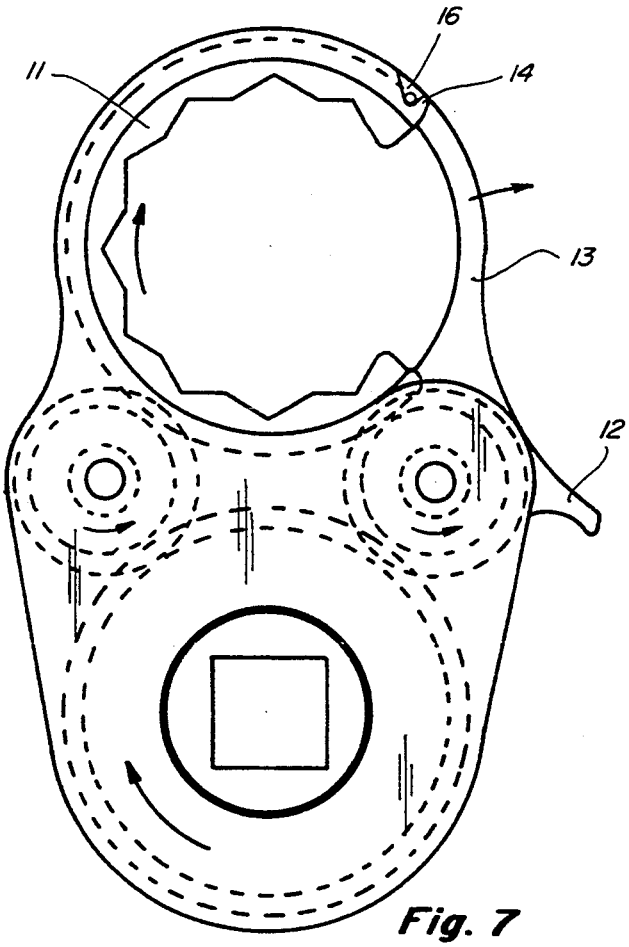
FIG. 7 is a top planar view of an alternate embodiment of the device showing the thumb release and closure mechanism.
Figure 8:
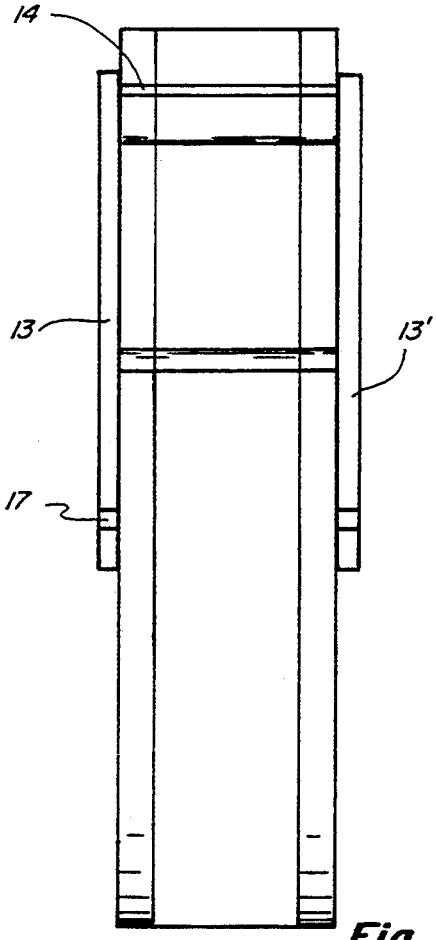
FIG. 8 is a side view of the device shown in FIG. 7.

The inner hexagonal shape 8 of the application gear 3 is designed such that this hexagonal gripping shape 8 is of the appropriate size and dimension to grip the standard size hexagonal line-nuts. It is within the contemplation of this invention that a series of offset line sockets, as shown in FIG. 1, would be available to the mechanic. A separate offset line socket would be used for each different size of hexagonal line-nut. The line socket is designed such that the lower point of the hexagonal shape 10 has a sufficient amount of metal material so that mechanical integrity is maintained. The inner hexagonal body 11 is made of steel, as are the gears and gear teeth so that a sufficient amount of torque force may be applied to a line nut to loosen or tighten the nut while in place. The standard sizes for the hexagonal line-nuts and hence the standard sizes for the hexagonal gripping shapes 8 would come in steps from ¼" to 3", as desired. This hexagonal shape 8 could also take the configuration commonly used for sockets and wrenches, as shown on FIG. 7.

Different types of gear geometrical arrangements for the gear teeth may be used depending upon the application of the specific socket. Standard or spur teeth gears are used in low torque or low tolerance situations. These spur teeth are straight and are standard in the industry. While in the ratcheting mode these teeth will not always be positively together due to the geometry of the gears and their relation to one another.

Figure 6:
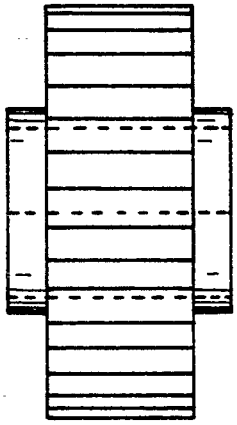
FIG. 6 is a detailed side view of the drive gear shown in FIG. 5.

For especially high torque or close tolerance situations, helical gears may be used. Helical gears would have the teeth slanted in one direction by approximately 14 to 20 degrees to drive a gear with teeth slanted approximately 14 to 20 degrees in the opposite direction. The use of a helical gear would provide a higher torque capability as well as a smoother operating mode since the teeth in helical gears are constantly in contact with one another. FIG. 2 shows the helical gear application while the gear shown in FIG. 6 is the standard spur gear.

An alternative embodiment of the device is shown in FIGS. 7 through 10. In many high torque situations, the line access opening 7 shown in FIG. 1 creates a high stress on each free side of the application gear. In very high stress situations this may cause the offset line socket to fail. In order to provide for such high torque, high stress applications, a high torque closure arm 13 is provided.

Figure 9:
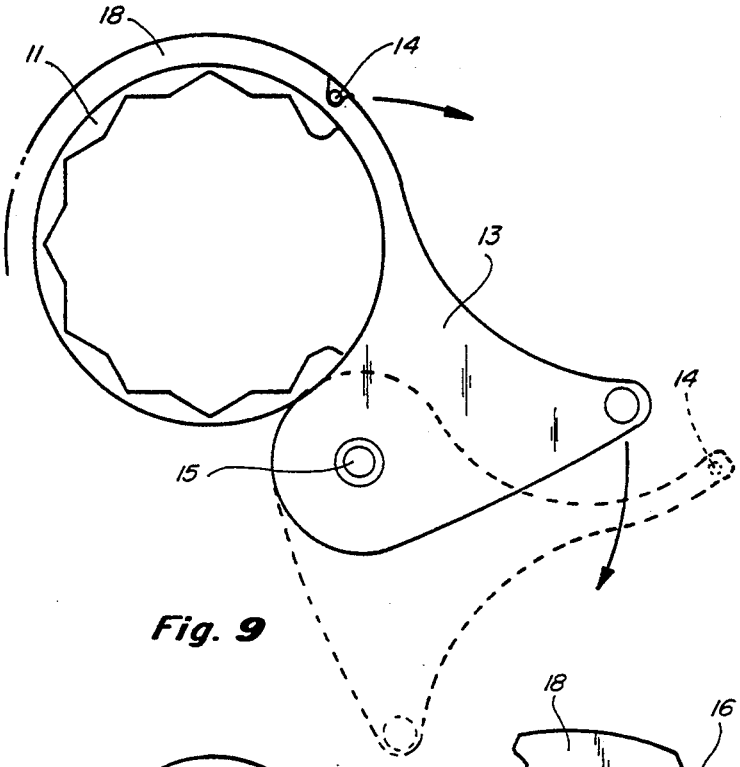
FIG. 9 is a partial top planar view of the application gear showing the high torque closure device.
Figure 10:
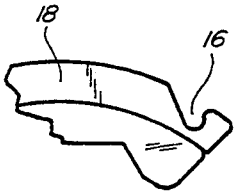
FIG. 10 is an exploded cut-off detailed view of the closure device showing the female closure tip.

This high torque closure arm 13 comprises essentially an arcuate arm which pivots about a closure pivot point 15 as shown on FIG. 9. Each side of the gear has a closure arm 13 and 13'. The closure arms 13 and 13' move together and pivot about a common axis.

The device is locked and unlocked by means of a thumb release 12 which enables the mechanic using the offset line socket to pivot the high torque closure arm 13 from the locked position (shown in solid lines on FIG. 9) to the unlocked position (shown in dashed lines on FIG. 9).

Figure 11:
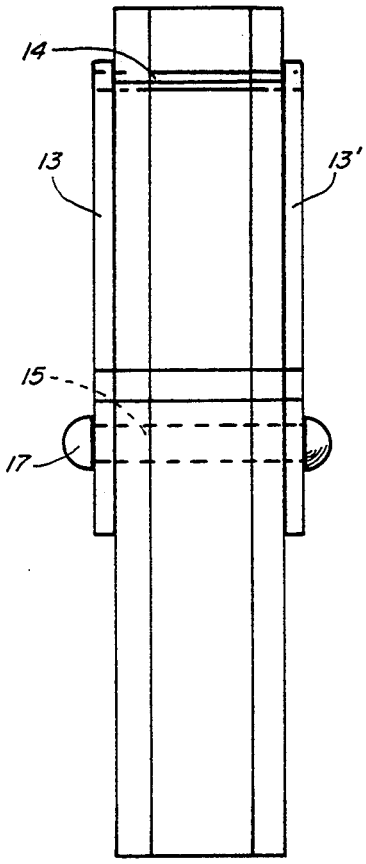
FIG. 11 is a side view of the device shown in FIG. 7.

In order to provide a complete mechanical circumference for the application gear 3, one simply pivots the high torque closure arm 13 into the closed position as shown on FIG. 9. Using the thumb release 12 to pivot the closure arm 13 brings the closure pin 14 into mechanical contact with the irregularly shaped female enclosure tip 16 (shown on FIG. 10). Closure pin 14 runs longitudinally across the width of the application gear 3 between closure arms 13 and 13'. The closure arm 13 pivots about closure pivot point 15 which may be conveniently attached to the offset line socket by means of a pivot point rivet 17 (FIG. 11). Once in the locked position, the closure arm 13 provides a complete mechanical circumference for the inner gripping body 11 and application gear 3. This closure device provides a very high coefficient of strength for the application gear and hence would allow a large amount of torque to be applied to the application gear through the drive gear without mechanical failure.

Figure 15:
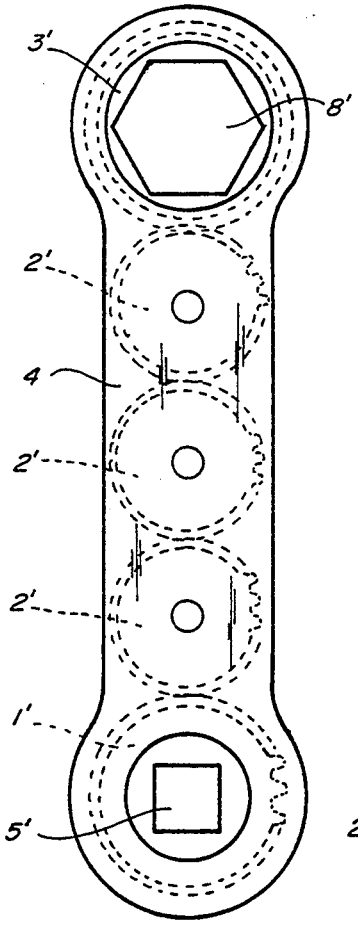
FIG. 15 is another alternate embodiment of the device showing a number of transfer gears arranged longitudinally between the drive and application gears.

Another embodiment of the device is shown and described in FIG. 15. In this particular device, a drive gear 1' is mechanically connected to a series of transfer gears 2' and ultimately to an application gear 3'. The radii of all of the gears in this embodiment are along a vertical longitudinal line. The gears are encased by casing 4' and driven by means of a standard drive gear drive stump 5'. The hexagonal gripping shape 8' is present within the application gear 3. In this particular embodiment, no provision is made for introducing the offset line socket onto a line. However, this embodiment would be useful in removing standard nuts from bolts located in low tolerance positions.

One further feature of this device involves removing the socket once the nut is tightened. Once the hexagonal line-nut has been tightened to the correct torque, it becomes important to remove the offset line socket from the hexagonal line-nut and pipe without further loosening or tightening the line-nut itself.

Removal of the socket is accomplished by removing the application gear from the nut and placing the application gear 3 over the line or pipe. The inner application gear 3 must then be returned to the open position (shown in FIG. 1) so that the opening 7 of the application gear 3 coincides with the opening 7' of the outer casing 4 (shown on FIGS. 1 and 3).

Aligning the gear opening 7 and outer casing opening 7' can be accomplished by reversing the ratchet on the drive stump 5 and turning the drive gear 1 until the openings 7 and 7' are in alignment. In order to insure alignment of the openings, a positioning stop arm 19, biased upwardly and a positioning pin 20 is provided.

Figure 12:
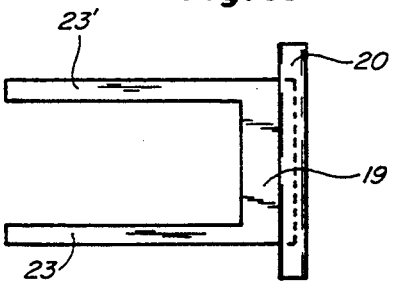
FIG. 12 is a top partial view of the stop mechanism, showing the stop bar in place.
Figure 13:
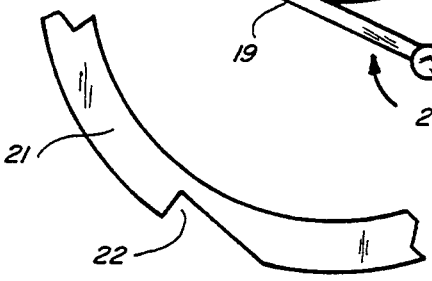
FIG. 13 is a top partial view of the stop mechanism without the stop bar.

The positioning stop arm 19 (shown in dotted lines on FIG. 1 and shown on FIGS. 12 and 14) is biased toward the gear stop cylinder 21 by means of a spring biased pin 20. The gear stop cylinders 21 and 21' shown in detail on FIGS. 4, 14 and 13 each have an irregularly shaped cut-out 22. This irregularly shaped cut-out 22 is best shown on FIG. 13. Each cut-out 22 on each cylinder 21 and 21' receives one of the tines 23 or 23' from the stop arm 19.

Figure 14:
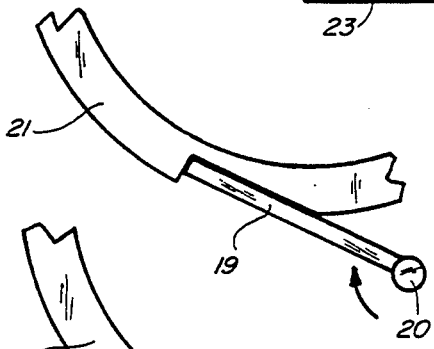
FIG. 14 is a side detailed view of the stop bar.

When the application gear 3 is turned in the clockwise directions the stop arm 19 allows such motion as shown on FIG. 14. However, once the direction is changed to a counterclockwise rotation, the application gear 3 turns only until it is locked in position by the stop arm 19, as shown on FIG. 14. The position of the openings 7 and 7' are aligned when the application gear 3 is in the positions shown in FIGS. 1, 3 and 14.

In order to tighten a nut, the offset line socket is placed over the nut as shown in FIG. 1. To loosen the nut, the offset line socket is turned over (the stump 5 now being underneath the socket rather than as shown in FIG. 1) and the nut loosened. The automatic stop arm 19 may then be utilized by reversing the ratchet as above.

In making a series of offset line sockets to accommodate the various sizes of line-nuts to be removed, the size of the transfer gears will vary according to the diameters of the drive and application gears. However, the minimum spacing requirements in order to obtain a continuous drive of the application gear must be maintained.

This device may be driven by the standard ratchet drive wrench, by a torque wrench, or by air or electrical power tools. The particular type of closure arm 13 shown in this embodiment may be varied while still keeping within the contemplation and scope of this invention. For example, the closure arm 13 may be connected to the outer circumference 18 of the application gear by means of a handcuff type fastening mechanism.

While these gears may be made of nylon or other synthetic fabrics for certain light torque situations, the preferred embodiment gears are made of all metal material and are machined or casted and encased fully within an outer casing. This outer casing protects the gears from damage or from the accumulation of foreign material.

Minor variations of the material, shapes, composition of the device, or exact configuration of the gear system may be made to this invention while still keeping within the contemplation and spirit of the device disclosed.

Having fully described my device, I claim:

1. An offset line socket, comprising:

(a) a drive gear mechanically connected to at least two transfer gears;

(b) transfer gears mechanically connected to said drive gear and to an application gear;

(c) an application gear having an inner irregular configuration and a line access opening for allowing a line to pass through said opening;

(d) an outer casing encompassing said drive, transfer and application gears, said casing having a line access opening;

(e) at least one gear stop cylinder, attached to at least one side of said application gear, each stop cylinder having a cut-out located on the circumference of said stop cylinder, said cut-out adapted to receive a stop arm;

(f) an upwardly biased stop arm in mechanical contact with said stop cylinder such that said stop cylinder turns freely in a clockwise direction but locks in a set position when said stop cylinder is rotated in a counterclockwise direction, wherein said set position is such that the line access opening of said application gear aligns with the line access opening of said casing.

2. An offset line socket as in claim 1, further comprising a pivotal closure arm which pivots to close said line access opening.

* * * * *